US005883366A

United States Patent [19]

Park

[11] Patent Number: 5,883,366

[45] Date of Patent: Mar. 16, 1999

[54] METHOD FOR CONTROLLING POWER RELAY OF MICROWAVE OVEN

[75] Inventor: Won-Kyoung Park, Kyungsangnam-Do, Rep. of Korea

[73] Assignee: LG Electronics Inc., Rep. of Korea

[21] Appl. No.: 689,504

[22] Filed: Aug. 13, 1996

[30] Foreign Application Priority Data

Aug. 14, 1995 [KR] Rep. of Korea ..... 1995/24986

[51] Int. Cl.[6] ..... H05B 6/68

[52] U.S. Cl. ..... 219/715; 219/716; 219/721; 219/702; 361/185

[58] Field of Search ..... 219/715, 716, 219/722, 721, 723, 702, 491, 492, 493, 519, 719; 361/185, 160, 187

[56] References Cited

U.S. PATENT DOCUMENTS

| | | | |
|---|---|---|---|
| 4,296,449 | 10/1981 | Eichelberger | 361/3 |
| 4,769,737 | 9/1988 | Ogita et al. | 361/203 |
| 5,008,516 | 4/1991 | Holling | 219/519 |
| 5,055,962 | 10/1991 | Peterson et al. | 361/187 |
| 5,218,509 | 6/1993 | Fowler | 361/185 |
| 5,255,152 | 10/1993 | Estes, III et al. | 361/160 |
| 5,267,120 | 11/1993 | Graff et al. | 361/185 |
| 5,357,087 | 10/1994 | Choi | 219/721 |

*Primary Examiner*—Philip H. Leung
*Attorney, Agent, or Firm*—Ostrolenk, Faber, Gerb & Soffen, LLP

[57] ABSTRACT

An improved method for controlling a power relay of a microwave oven which is capable of reducing the generation of sparking which occurs when the contact points of the power relay are separated, by turning off the power relay at a time (2n−1) π+3/4πduring the "+" cycle and at a time 2nπ+3/4π during the "−" cycle in the voltage phase or the current phase, for separating the contact points when the flow of the current is decreased, thus extending the life span of the relay. The method includes judging whether the power relay was previously turned off during the "+" cycle of the power voltage or during the "−" cycle of the power voltage when a clock signal of 50 Hz/60 Hz is inputted, and turning off the power relay after an apex of the "+" or "−" cycle of the power voltage after delaying the output time of a relay driving signal for a predetermined time in accordance with the judgement.

3 Claims, 6 Drawing Sheets

METHOD FOR CONTROLLING POWER RELAY OF MICROWAVE OVEN

BACKGROUND OF THE INVENTION

1. Field of the Invention

The present invention relates to a method for controlling a power relay of a microwave oven, and particularly to an improved method for controlling a power relay of a microwave oven which is capable of preventing damage of a power relay contact point and extending the life span of the relay.

2. Description of the Conventional Art

FIG. 1 shows a conventional power relay On/Off control apparatus for a microwave oven, which includes a power unit 10 for supplying power to connected elements, a microcomputer 1 for controlling the operation of the microwave oven in accordance with control signals inputted thereto, a reset unit 2 for initializing the microwave oven upon the initial application of power, a 50 Hz/60 Hz clock input unit 3 for supplying a clock signal having a frequency of 50 Hz/60 Hz to the microcomputer 1, a buzzer controller 4 for generating an alarm signal by outputting a control signal to the microcomputer 1 when the microwave oven is not operational, a door detector 5 for detecting whether the door of the microwave oven is open or closed, a power relay controller 6 for switching the power to a high voltage transformer in accordance with the control of the microwave oven 1 and for adjusting the output of a magnetos, a display controller 7 for displaying the operation state of the microwave oven in accordance with the control of the microcomputer 1, a key input detector 8 for detecting the state of a selection key which a user presses for selecting one among various kinds of cooking modes, and a main relay controller 9 for driving a load in accordance with the control of the microcomputer 1.

As shown in FIG. 2, the microcomputer 1 includes a central processing unit (CPU) 11 for performing various control operations in accordance with input signals inputted thereto, a 50 Hz/60 Hz clock input detector 12 for detecting the clock signal of 50 Hz/60 Hz, which is inputted thereto from the clock input unit 3, in accordance with the control of the CPU 11 and for outputting a detection signal, a power relay On/Off controller 18 for outputting a relay driving signal to the power relay controller 6 in accordance with the detection state of the 50 Hz/60 Hz clock input detector 12 and for deciding whether or not to open or close the contact point of the power relay of the power relay controller 6 during the "+" cycle or the "−" cycle of the power voltage, a relay on/off signal generator 14 for generating a relay on/off signal in accordance with the control signal outputted from the CPU 11, a common controller 13 for controlling the operation of the relay on/off signal generator 14 in accordance with the output signals of the 50 Hz/60 Hz clock input detector 12 and the CPU(11), an inner register 15 for storing data outputted from the CPU 11, a random access memory (RAM) 16, and a read only memory (ROM) 17.

The power relay on/off controller 18, as shown in FIG. 3, includes a 50 Hz/60 Hz clock generator 18*a* for generating a clock signal having a frequency of 50 Hz/60 Hz in accordance with the control of the CPU 11, an inverter I1 for inverting the output signal from the 50 Hz/60 Hz clock generator 18*a*, an inverter I2 for inverting the output signal from the relay on/off signal generator 14 of the microcomputer 1, an AND-gate A1 for ANDing the output signals of the inverter I1 and the inverter I2, a pulse generator 18*b* for generating a pulse signal in accordance with the output signal of the relay on/off signal generator 14 of the microcomputer 1, an AND-gate A2 for ANDing the output signal of the pulse generator 18*b* and the output signal of the inverter I1, an AND-gate A3 for ANDing the output signals of the pulse generator 18*b* and the 50 Hz/60 Hz clock generator 18*a*, an AND-gate A4 for ANDing the output signals of the inverter I1 and the 50 Hz/60 Hz clock generator 18*a*, a pulse generator 18*c* for generating a pulse signal in accordance with the output signal of the AND-gate A1, a flip-flop 18*d* for controlling opening/closing of the contact point of the relay during the "+" or "−" cycle of the power voltage, an AND-gate A5 for ANDing the output signal of the /Q output terminal of the flip-flop 18*d* and the output signal of the pulse generator 18*c*, an AND-gate A6 for ANDing the output signal of the /Q output terminal of the flip-flop 18*d* and the output signal of the AND-gate A2 and for applying the ANDed signal to the clock input of the flip-flop 18*d*, an AND-gate A7 for ANDing the signal of the Q output terminal of the flip-flop 18*d* and the output signal of the AND-gate A3, a pulse generator 18*e* for generating a pulse signal in accordance with the output signal of the AND-gate A4, an AND-gate A8 for ANDing the output signal of the pulse generator 18*e* and the signal of the Q output terminal of the flip-flop 18*d*, a relay off controller 18*f* for outputting a clock signal R in accordance with the output signals of the AND-gates A5 and A8, a relay On controller 18*g* for outputting a clock signal S in accordance with the output signals of the AND-gates A6 and A7, and a relay driving apparatus for receiving the output signals R and S from the relay On controller 18*g* and the relay Off controller 18*f* and for outputting the relay driving signal to the power relay controller 6.

The operation of the power relay of/off controller for a conventional microwave oven will now be explained with reference to the accompanying drawings.

The clock signal of 50 Hz/60 Hz outputted from the 50 Hz/60 Hz clock input unit 3 is inputted into the 50 Hz/60 Hz clock input detector 12 of the microcomputer 1, and the 50 Hz/60 Hz clock input detector 12 detects the state of the 50 Hz/60 Hz clock in accordance with the control of the CPU 11, and applies the detected signal to the 50 Hz/60 Hz clock generator 18*a* of the power relay on/off controller 18.

In step ST1, the CPU 11 of the microcomputer 1 judges whether the 50 Hz/60 Hz clock signal is outputted from the 50 Hz/60 Hz clock generator 18*a* during the "+" or "−" cycle of the power voltage, and in step ST2, when the 50 Hz/60 Hz clock signal is outputted during the "+" cycle, it is judged whether a relay on flag stored in the RAM 16 is set. Here, the relay on flag is a predetermined data indicating whether the power relay is turned on or off.

As a result of the judgement, if the relay on flag is set, the CPU 11 judges whether the "+" cycle on flag is set in step ST3, and if the "+" cycle on flag is set, step ST4 is performed. Here, the "+" cycle on flag is stored in the RAM 16, and refers to the data indicating whether the power relay is on during the "+" or "−" cycle of the power voltage.

Namely, in step ST4, the relay on/off signal generator 14 outputs a high level signal in accordance with the control of the CPU 11, and controls the 50 Hz/60 Hz clock generator 18*a* to output a high level signal.

When the output of the 50 Hz/60 Hz clock generator is a high level, the AND-gates A1, A2, A5 and A6 output a low level signal, and the AND-gates A3 and A7 output a high level signal.

Therefore, the relay off/on control apparatuses 18*f* and 18*g* output control signals, respectively, and the relay driving apparatus 18*h* applies the relay driving signal to the power relay controller 6, and turns on the power relay.

The CPU 11 resets the "+" cycle on flag, and finishes the control process.

Meanwhile, if it is judged that the relay on flag is not set in step ST2, the CPU 11 judges whether the "+" cycle on flag is set in step ST5. As a result, if it is set, step ST6 is performed.

Namely, in step ST6, the relay on/off signal generator 14 outputs a low/high level signal in accordance with the control of the CPU 11. When the clock signal outputted from the 50 Hz/60 Hz clock generator 18*a* is a high level, the AND-gate A4 outputs a high level signal to the clock generator 18*e*, and the pulse generator 18*e* outputs a high level signal to the AND-gate A8.

The relay off/on controllers 18*f* and 18*g* output the control signals, respectively, and the relay driving apparatus 18*h* applies the relay driving signal to the power relay controller 6, and turns off the power relay.

Meanwhile, if the output signal from the 50 Hz/60 Hz clock generator 18*a* is a low level in step ST1, in step ST7, the CPU 11 judges whether the relay on flag is set. When the relay on flag is set, the CPU 11 performs step ST8.

Namely, in step ST8, it is judged whether the "+" cycle on flag is set. If it is set, the control process is finished. If it is not set, the 50 Hz/60 Hz clock generator 18*a* is enabled to output a low level signal. At this time, the on/off signal generator 14 outputs a high level signal.

In case that the output signal from the 50 Hz/60 Hz clock generator 18*a* is a low level, the AND-gates A3, A4, A7, and A8 output a low level signal, respectively, and the AND-gates A1, A2, and A6 output a high level signal, respectively.

Thereafter, as was described for step ST1, the power relay is turned on, and the CPU 11 sets the "+" cycle on flag.

If it is judged in step ST7 that the relay on flag is not set, the CPU (11) judges whether the "+" cycle on flag is set in step ST9. As a result, it is set, the control process is finished. If the "+" cycle on flag is not set, the relay on/off signal generator 14 outputs a low level signal in accordance with the control of the CPU 11, and a pulse signal is applied to the input of the AND-gate A5.

At this time, when the signal outputted through the Q output terminal Q of the flip-flop 18*d* is a high level, the relay off controller 18*f* is operated, and the power relay is turned off in accordance with the process of step ST6.

However, in the above-described conventional art, when the relay contact point of the power relay is opened at a predetermined point "A" (or "A'"), a spark is generated during the time from the point "A" (or "A'") to the point "C" (or "C'") even when the relay point is opened at the point "A" (or "A'"), and the current flows therethrough.

Since the spark generation time is lengthy, and a lot of current flows therein, the relay contact point may be damaged, and the life span of the relay is shortened.

SUMMARY OF THE INVENTION

Accordingly, it is an object of the present invention to provide a method for controlling a power relay of a microwave oven, which overcomes the problems encountered in the conventional method for controlling a power relay of a microwave oven.

It is another object of the present invention to provide an improved method for controlling a power relay of a microwave oven which is capable of reducing the generation of the spark which occurs when the contact points of the power relay are separated and by turning off the power relay at a phase of $(2n-1)\pi+3/4\pi$ during the "+" cycle and at a phase of $2n\pi+3/4\pi$ during the "−" cycle in the voltage phase or the current phase and which is capable of separating the contacts when the flow of the current is decreased, thus extending the life span of the relay.

To achieve the above objects, there is provided a method for controlling a power relay of a microwave oven, which includes the steps of judging whether the power relay is previously turned off during a "+" cycle of a power voltage or during a "−" cycle of the power voltage when a clock signal of 50 Hz/60 Hz is inputted thereto; and turning off the power relay after an apex of the "+" or "−" cycle of the power voltage after delaying the output time of a relay driving signal for a predetermined time in accordance with the judgement.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 5A and 5B are wave forms showing a turning-off time of a power relay in accordance with the conventional control method, of which:

FIG. 5A is a wave form of a "+" cycle of a power voltage; and

FIG. 5B is a wave form of a "−" cycle of a power voltage;

FIGS. 7A and 7B are wave forms of a power voltage showing a power relay turning-off time in accordance with the control method according to the present invention, of which:

FIG. 7A is a wave form of a "−" cycle of a power voltage; and

FIG. 7B is a wave form of a "+" cycle of a power voltage.

DETAILED DESCRIPTION OF THE INVENTION

Figure 1:
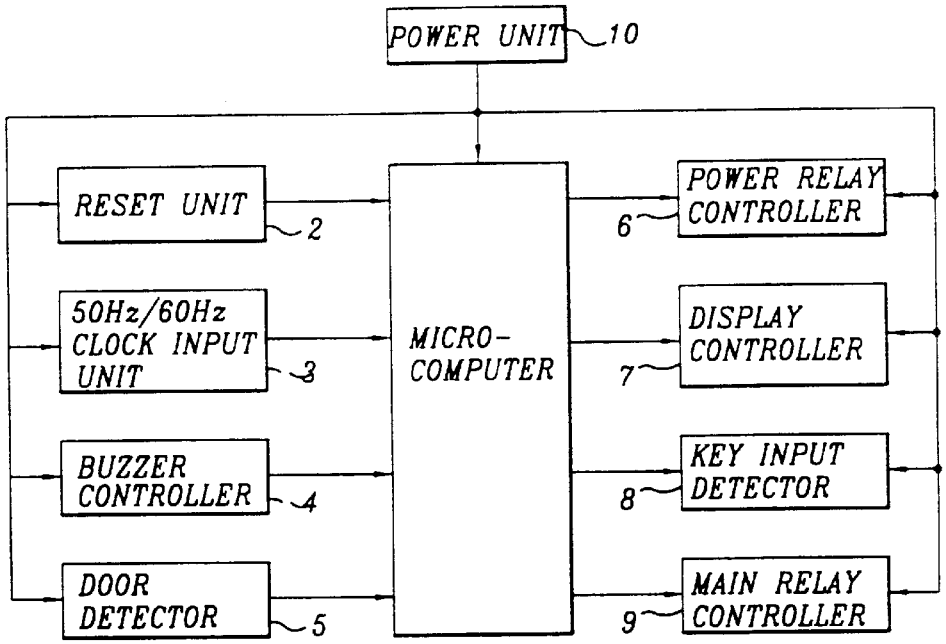
FIG. 1 CONVENTIONAL ART
FIG. 1 is a block diagram showing a power relay on/off control apparatus for a conventional microwave oven.
Figure 2:
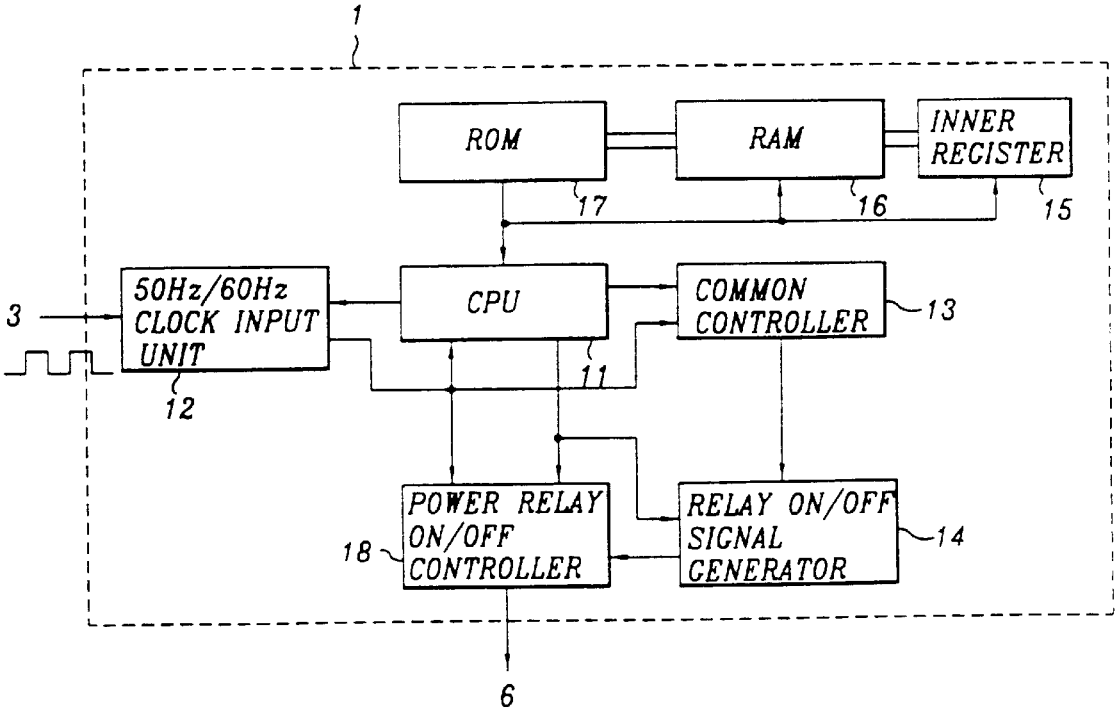
FIG. 2 CONVENTIONAL ART
FIG. 2 is a block diagram of a microcomputer of FIG. 1.
Figure 3:
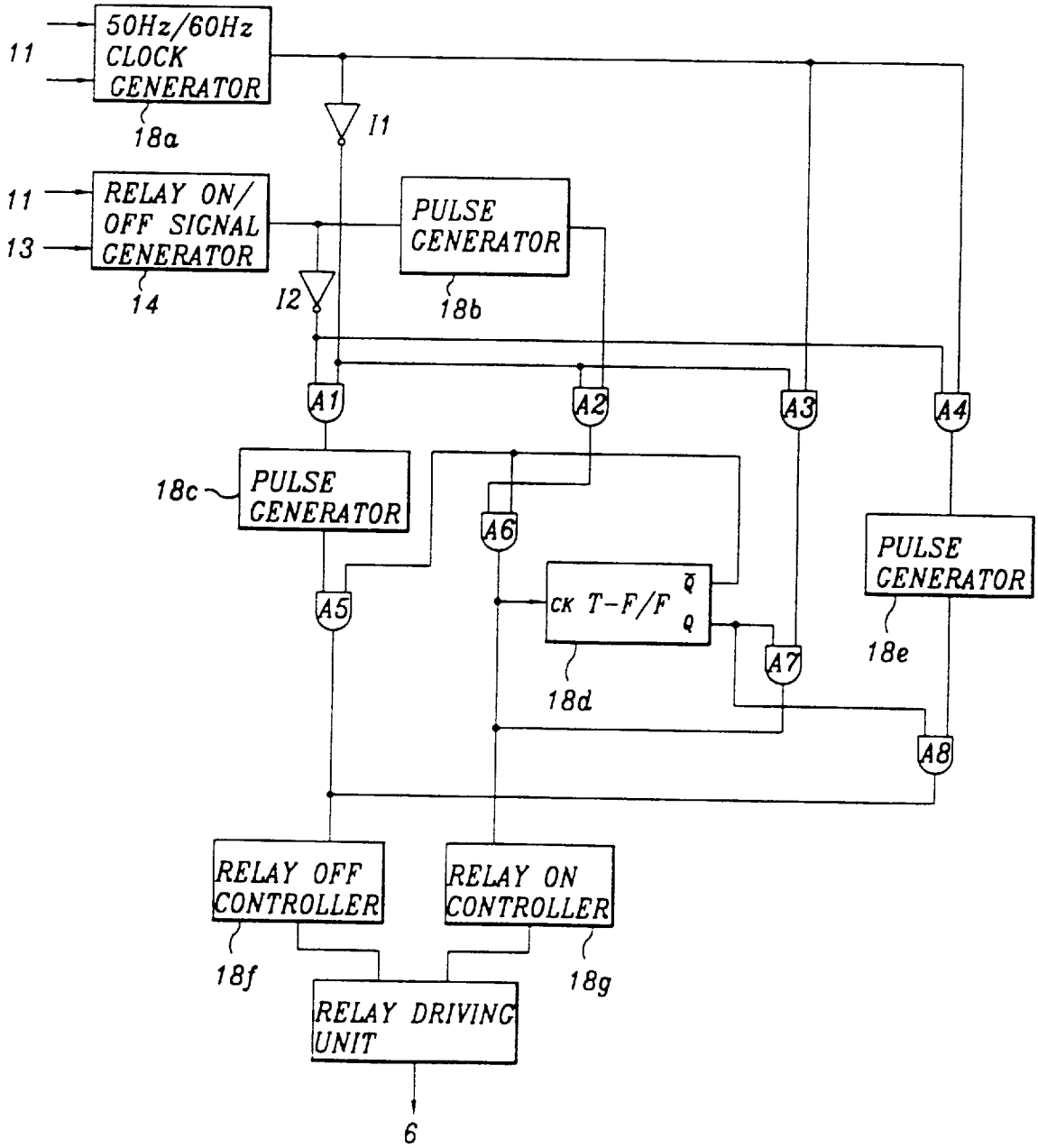
FIG. 3 CONVENTIONAL ART
FIG. 3 is a circuit diagram of a power relay on/off controller of FIG. 2.
Figure 4:
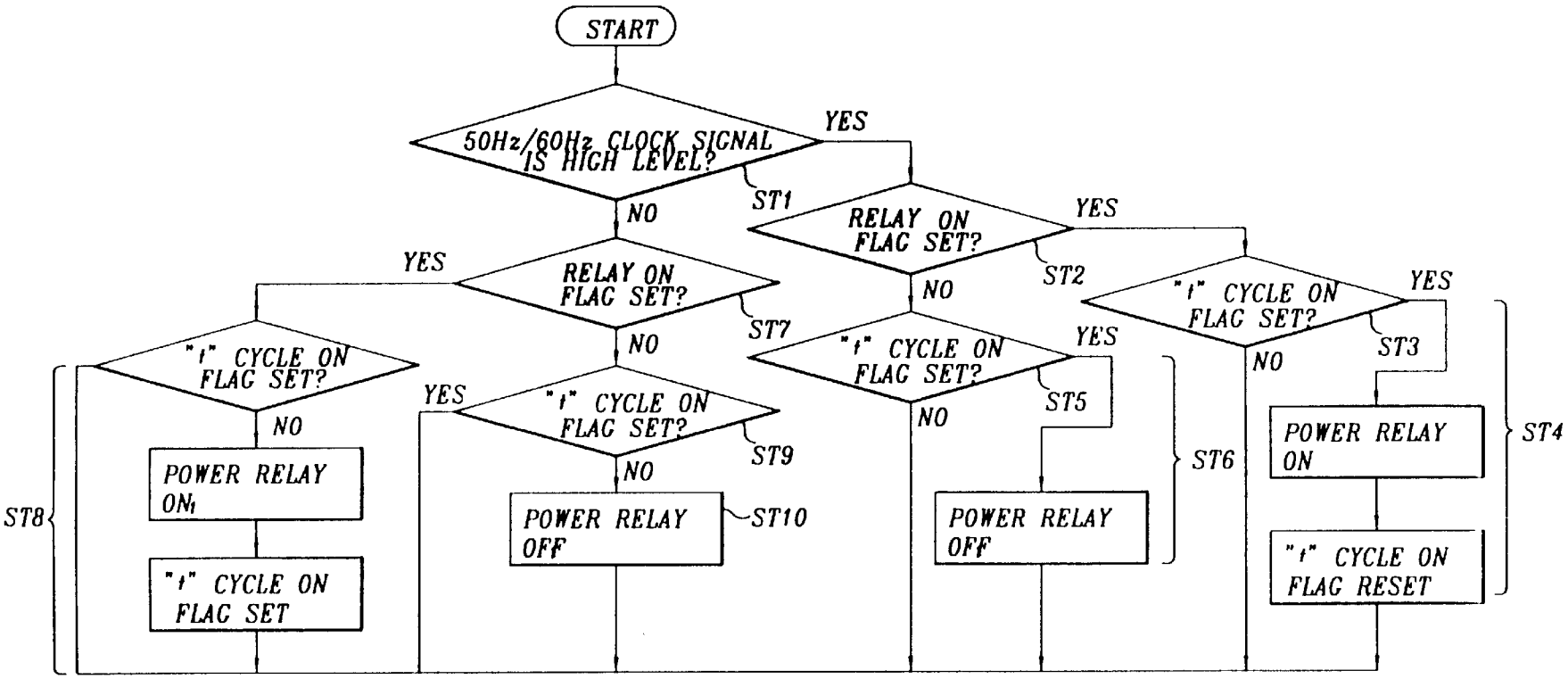
FIG. 4 CONVENTIONAL ART
FIG. 4 is a flow chart of a conventional power relay on/off control method of a microwave oven.
Figure 5A:
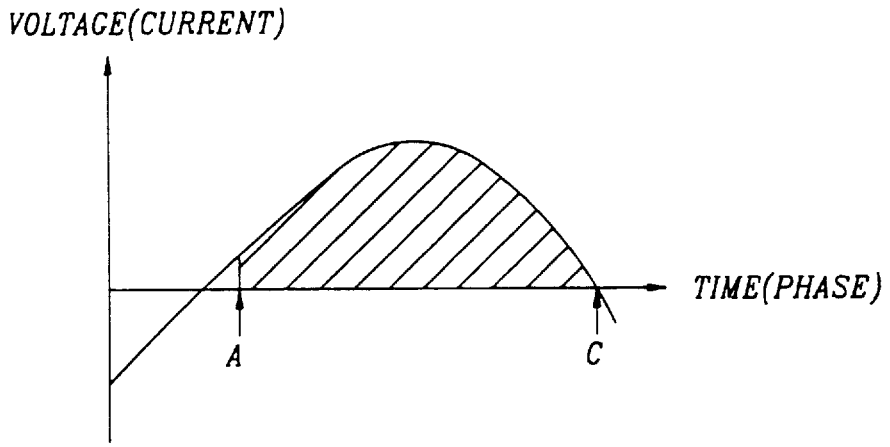
FIG. 5A CONVENTIONAL ART
Figure 5B:
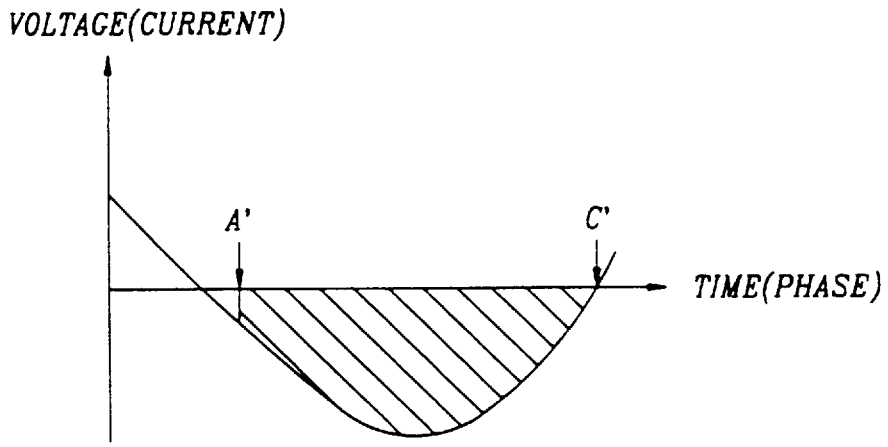
FIG. 5B CONVENTIONAL ART

The control method of the present invention is performed by the apparatus shown in FIGS. 1 through 3.

The processes and effects of the present invention will now be explained in detail with reference to FIGS. 6 through 7B.

Parts and assemblies which correspond to those in FIGS. 1 through 5B according to the conventional art are assigned identical reference numerals and their repeated detailed description will be omitted herein.

Figure 6:
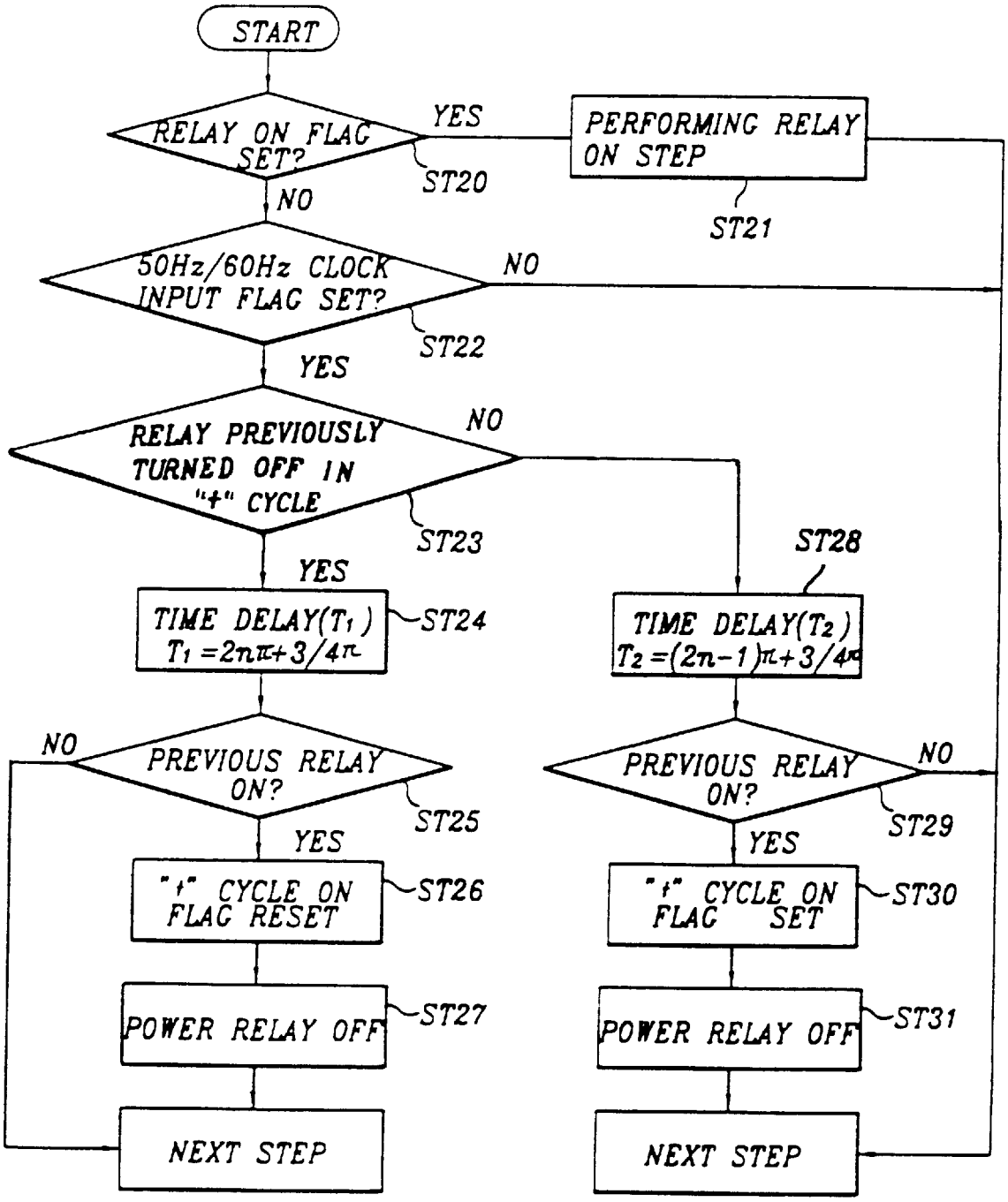
FIG. 6 is a flow chart of a power relay control method for a microwave oven according to the present invention.

Referring to the flow chart of the present method shown in FIG. 6, in step ST20, the CPU 11 judges whether the relay on flag is set. As a result, if it is set, the power relay is turned on in step ST21 in accordance with the conventional processes. Here, the "+" cycle on flag may be set. If the relay on flag is not set, in step ST22, the CPU 11 judges whether the 50 Hz/60 Hz clock input flag stored in the RAM 16 is set. Here, when the clock signal of 50 Hz/60 Hz is inputted to the 50 Hz/60 Hz clock input unit 12, the CPU 11 sets the 50 Hz/60 Hz clock input flag.

As a result of step ST22, when the 50 Hz/60 Hz clock input flag is not set, the CPU 11 performs the next process, and when the 50 Hz/60 Hz clock input flag is set, it is judged in step ST23 whether the relay was previously turned off in a "+" cycle of a power voltage or a "−" cycle of the power voltage. If the relay was not previously turned off in a "+" cycle, in step ST24, the CPU 11 controls the power relay on/off controller 18 in order for the output time of the relay driving signal to be delayed for a predetermined time T1. Here, the delay time T1 is referred to the timing of $2n\pi+3/4\pi$ of the power voltage phase (n=0,1,2,3, . . . , n).

Namely, in step ST24, the CPU 11 outputs the control signal to the relay on/off signal generator 14 and the power relay on/off controller 18, respectively, and the output of the relay driving signal is delayed for a time $2n\pi+3/4\pi$ of the power voltage phase.

Thereafter, in step ST25, the CPU 11 checks whether the power relay was previously turned on. As a result, it was not turned on, the CPU 11 performs the next step, and if it was turned on, the CPU 11 resets the "+" cycle on flag in step ST26.

In step ST27, the relay on/off signal generator 14 outputs the relay off signal to the power relay on/off controller 18 in accordance with the control of the CPU 11, and the power relay on/off controller 18 outputs a relay driving signal in accordance with the control signal from the CPU 11 and the relay off signal from the relay on/off signal generator 14 and turns off the power relay. Thereafter, the next step is performed.

In step ST23, if the CPU 11 judges that the power relay was previously turned off during the "−" cycle of the power voltage, then step ST28, the CPU 11 controls the power relay on/off controller 18 in order for the output timing of the relay driving signal to be delayed for a predetermined time T2. Here, the delay time T2 is referred to a time $(2n-1)\pi+3/4\pi$ of the power voltage phase.

Namely, in step ST28, the CPU 11 outputs the control signal to the relay on/off signal generator 14 and the power relay on/off controller 18, respectively, and the output of the relay driving signal is delayed for the time $(2n-1)\pi+3/4\pi$ of the power voltage phase.

In step ST29, the CPU 11 checks whether the power relay was previously turned on. As a result, if it was not turned on, the next step is processed. If it was turned on, the "+" cycle on flag is set in step ST30.

Thereafter, the power relay is turned off as in step ST31 as in step ST27.

Figure 7A:
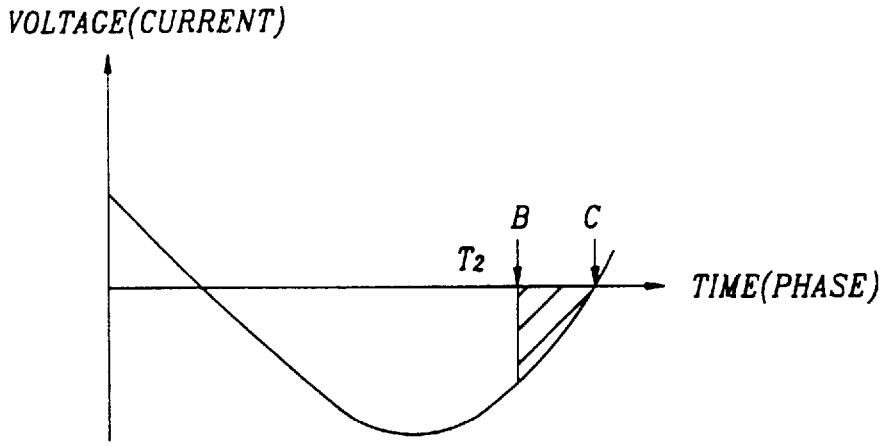
Figure 7B:
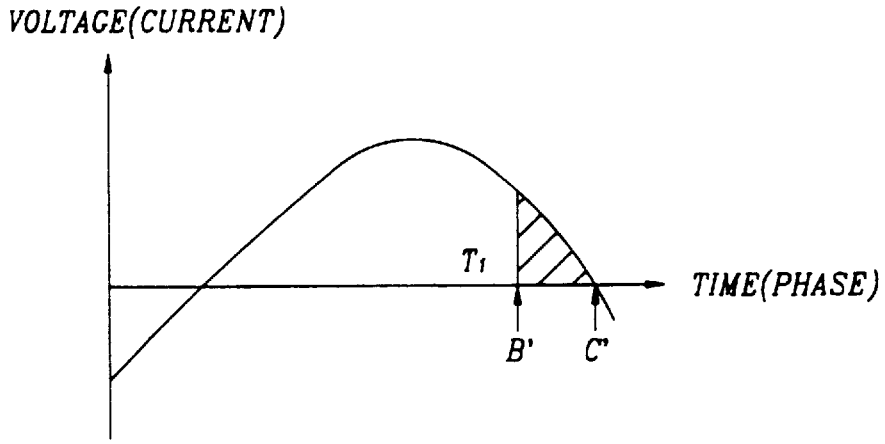

Referring to FIG. 7B, when the power relay was previously turned off during the "−" cycle, the point "B'" refers to the delay time T1 in the power voltage phase, namely, it refers to the timing of $2n\pi+3/4\pi$.

In addition, referring to FIG. 7A, when the power relay was previously turned off during the "+" cycle, the point "B'" refers to the delay time T2 at the power voltage phase, Namely, it refers to the time $(2n-1)\pi+3/4\pi$.

Of course, the power relay is preferably turned off near the point "C" or the point "C'". The present invention is directed to turning off the power relay at a predetermined point prior by $1/4\pi$ to the point "C" or "C'" in consideration of the relay timing error which may occur during a mass production. So, most of the relay contact points are opened prior to the point "C" or "C'".

As described above, when the relay contact point is opened at $2n\pi+3/4\pi$ or $(2n-1)\pi+3/4\pi$ of the power voltage phase, the spark occurs at the contact points from the points "B" to "C" or from the points "B'" to "C'". However, since the spark generation time is short, and the current amount is small, it is possible to prevent any damage of the relay contact points, and it is possible to significantly reduce the breakage of the contact points of the power relay by turning the relay off in turn at $2n\pi+3/4\pi$ and $(2n-1)\pi+3/4\pi$ (n=0,1, 2,3, . . . , n).

In addition, the present invention is directed to reducing the spark which occurs when the power relay is turned off, and to turning off the power relay when a small amount of current flows, thus extending the life span of the power relay.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A method of controlling a power relay of a microwave oven, comprising:

a first step of judging whether the power relay was previously turned off during a "+" cycle of a power voltage or during a "−" cycle of the power voltage in accordance with a clock signal of 50 Hz/60 Hz inputted; and a second step of turning off the power relay after an apex of the "+" or "−" cycle of the power voltage after delaying an output time of a relay driving signal from said power relay for a predetermined time in accordance with the judgement obtained in the first step;

wherein in said second step, the output time of the relay driving signal is delayed by a time $2n\pi+3/4\pi$ of a voltage phase of the power voltage when said power relay was previously turned off during the "+" cycle of the power voltage, and the output time of the relay driving signal is delayed by a time $(2n-1)\pi+3/4\pi$ of the voltage phase of the power voltage when the power relay was previously turned off during the "−" cycle of the power voltage, wherein n represents 0, 1, 2, 3, . . . n.

2. The method of claim 1, wherein said first step includes the sub-steps of:

a first sub-step of judging whether a relay on flag is set;

a second sub-step of judging whether a 50 Hz/60 Hz input flag is set when the relay on flag is set, and for turning on the power relay when the relay on flag is not set; and a third sub-step of judging whether a "+" cycle on flag is set.

3. The method of claim 1, wherein said second step includes the sub-steps of:

a first sub-step of judging whether the power relay was previously turned on;

a second sub-step of resetting a "+" cycle on flag; and a third sub-step of turning off the power relay.

* * * * *